US008820578B2

(12) United States Patent
Kneer et al.

(10) Patent No.: US 8,820,578 B2
(45) Date of Patent: Sep. 2, 2014

(54) PACKAGING

(75) Inventors: Roland Kneer, Farchant (DE); Alexander Keller, Unterammergau (DE)

(73) Assignee: Gaplast GmbH, Altenau (DE)

( * ) Notice: Subject to any disclaimer, the term of this patent is extended or adjusted under 35 U.S.C. 154(b) by 0 days.

(21) Appl. No.: 13/577,341

(22) PCT Filed: Feb. 18, 2011

(86) PCT No.: PCT/DE2011/000149
§ 371 (c)(1), (2), (4) Date: Aug. 6, 2012

(87) PCT Pub. No.: WO2011/103856
PCT Pub. Date: Sep. 1, 2011

(65) Prior Publication Data

US 2012/0305566 A1 Dec. 6, 2012

(30) Foreign Application Priority Data

Feb. 24, 2010 (DE) ..... 10 2010 009 101

(51) Int. Cl.
*B65D 35/28* (2006.01)

(52) U.S. Cl.
USPC ..... 222/95; 222/213; 222/215; 222/94; 222/105; 222/491

(58) Field of Classification Search
USPC ..... 222/95, 94, 105, 212, 213, 215, 496, 222/491
See application file for complete search history.

(56) References Cited

U.S. PATENT DOCUMENTS 2,344,548 A 3/1944 Goetz
4,449,242 A 5/1984 Sliney, Jr.
(Continued)

FOREIGN PATENT DOCUMENTS

DE 9200245 4/1992
DE 4332885 3/1994
(Continued)

OTHER PUBLICATIONS

European Patent Office Machine Translation of EP 0 505 611 A2.*
(Continued)

*Primary Examiner* — Paul R Durand
*Assistant Examiner* — Jeremy W Carroll
(74) *Attorney, Agent, or Firm* — Greer, Burns & Crain, Ltd.

(57) ABSTRACT

The packaging comprising an essentially dimensionally stable, elastically deformable external container, an easily deformable inner bag arranged therein, which receives the filling material, and a valve, is characterized in that the valve comprises a base body which extends over the opening of the external container and comprises at least one through opening for the filling material and a pin oriented away from the external container, and a cap which is fastened to the neck of the external container and covers the base body and the upper end wall of which is formed by a membrane which delimits a receiving chamber for the filling material between the cap and the base body and comprises an outlet opening for the filling material which in the unpressurized state of the packaging is closed by the pin in that the membrane with the area containing the outlet opening rests under preload on the pin, the membrane being lifted from the pin upon exertion of pressure on the external container by the pressurized filling material contained in the receiving chamber, so that filling material can exit, and that the cap comprises an air chamber which is separated from the receiving chamber for the filling material and sealed relative to the receiving chamber and the external container and which is connected via at least one hole through the wall of the external container to the intermediate chamber between the external container and the inner bag and via at least one venting valve to the exterior atmosphere.

10 Claims, 3 Drawing Sheets section A-A

(56) References Cited

U.S. PATENT DOCUMENTS

| | | | | |
|---|---|---|---|---|
| 4,474,314 | A | 10/1984 | Roggenburg, Jr. | |
| 4,506,809 | A | 3/1985 | Corsette | |
| 4,969,577 | A * | 11/1990 | Werding | 222/94 |
| 5,033,647 | A | 7/1991 | Smith et al. | |
| 5,226,568 | A | 7/1993 | Newton et al. | |
| 5,529,213 | A * | 6/1996 | Mack et al. | 222/95 |
| 5,692,651 | A | 12/1997 | Fuchs | |
| 5,857,595 | A | 1/1999 | Nilson | |
| 6,050,444 | A | 4/2000 | Sugg | |
| 6,386,404 | B1 | 5/2002 | Auer | |
| 6,616,012 | B2 * | 9/2003 | Dark | 222/1 |
| 6,742,676 | B2 | 6/2004 | Nakamura et al. | |
| 6,953,027 | B2 * | 10/2005 | Veinotte | 123/520 |
| 6,974,053 | B2 | 12/2005 | Lautre et al. | |
| 7,516,874 | B2 | 4/2009 | Kneer | |
| 8,267,280 | B2 | 9/2012 | Kneer et al. | |
| 8,464,908 | B1 * | 6/2013 | Tabor | 222/95 |
| 8,485,398 | B2 | 7/2013 | Kneer | |
| 2002/0190079 | A1 | 12/2002 | Hamamoto | |
| 2003/0089735 | A1 * | 5/2003 | Iwatsubo | 222/95 |
| 2005/0224520 | A1 * | 10/2005 | Janssen et al. | 222/190 |
| 2006/0197042 | A1 * | 9/2006 | Kneer | 251/82 |
| 2007/0045356 | A1 | 3/2007 | Foster | |
| 2012/0305602 | A1 | 12/2012 | Kneer et al. | |

FOREIGN PATENT DOCUMENTS

| | | | | |
|---|---|---|---|---|
| DE | 19623030 | | 12/1997 | |
| DE | 10220469 | | 11/2002 | |
| DE | 10157423 | | 6/2003 | |
| DE | 10217655 | | 11/2003 | |
| DE | 10247246 | | 4/2004 | |
| EP | 0505611 | | 9/1992 | |
| EP | 505611 | A2 * | 9/1992 | B65D 83/00 |
| FR | 2655315 | | 6/1991 | |
| GB | 2122586 | | 1/1984 | |
| GB | 2258860 | | 2/1993 | |

OTHER PUBLICATIONS

International Search Report, mailing date Oct. 26, 2011, issued by the European Patent Office.

* cited by examiner 2
3
27
31
30
7
8
11
13
5
14
21a
29
30a

DETAIL B

PACKAGING

This application is a U.S. National Stage under 35 U.S.C. §371 of International Application No. PCT/DE2011/000149, filed Feb. 18, 2011, which claims priority from German Patent Application No. 10 2010 009 101.4, filed Feb. 24, 2010 under 35 U.S.C. §§119 and 365.

FIELD OF THE INVENTION

The present invention refers to packaging comprising an essentially dimensionally stable, elastically deformable external container, an easily deformable inner bag arranged therein, which receives the filling material, and a valve through the opening of which filling material is discharged when pressure is exerted on the external container. This is a so-called airless system in which after discharge of filling material air does not enter into the inner bag, but air enters out of the exterior atmosphere into the intermediate chamber between the external container and the inner bag, with the inner bag being more and more compressed and remaining in that state until the whole filling material has exited out of the packaging, which is also called squeeze bottle.

BACKGROUND

Numerous types of packaging are known. For instance, DE 102 17 655 A1 discloses packaging in which the valve comprises a membrane with a sleeve-like projection which surrounds a pin of a base body extending over the opening of the external container, the filling material passing between the sleeve and the pin to the exit opening of a cap. When this packaging is used for liquid filling material, it may happen that the sleeve-like section of the membrane adheres in places to the pin of the base body upon discharge of filling material, which has the consequence that upon squeezing of the external container the liquid jet will not exit in the longitudinal direction of the external container, but in an oblique direction, so that said packaging is only suited to a limited degree for discharging liquid filling material.

SUMMARY

It is the object of the present invention to indicate packaging which is made up of few parts and which can be produced and assembled with little efforts and which is preferably also suited for liquid filling material. The packaging, however, shall not be limited thereto, but should just as well be suited for discharging pasty filling material.

This object is achieved according to the invention by a packaging comprising an essentially dimensionally stable, elastically deformable external container as more fully described herein below.

According to the invention the valve of the packaging comprises a base body which extends over the opening of the external container and comprises at least one through opening for the filling material and a central pin oriented away from the external container, and a cap which is fastened to the upper end portion or to the neck of the external container and covers the base body and the upper, preferably slightly outwardly curved end wall of which is formed by an elastic membrane which delimits a receiving chamber for the filling material between the cap and the base body and comprises a central outlet opening for the filling material which in the unpressurized state of the packaging is closed by the pin, in that the membrane with the edge portion surrounding the outlet opening rests under preload on the pin, the membrane being lifted from the pin upon exertion of pressure on the external container by the pressurized filling material contained in the receiving chamber, so that filling material can exit. In this process the filling material, if it is a liquid, exits in the longitudinal direction of the exit opening in a straight jet out of the opening the bore of which is in alignment with the longitudinal axis of the external container because the liquid contained in the receiving chamber can pass in unhindered fashion from the pin spaced apart from the outlet opening into said outlet opening. The receiving chamber thereby occupies almost the whole interior of the part of the cap that is positioned above the base body, so that the filling material is pressed over a large area onto the membrane which is thereby lifted from the pin by a route that is so long that the filling material is pressed in unhindered fashion into the outlet opening. The lifting of the membrane is even facilitated in an advantageous configuration of the invention in that the membrane is provided on the edge of the receiving chamber with a surrounding weakened cross-section.

Furthermore, according to the invention the cap comprises an air chamber which is separated from the receiving chamber for the filling material and sealed with respect to the receiving chamber and the outer wall of the external container and which is connected by means of at least one hole through the wall of the external container to the intermediate chamber between the external container and the inner bag and to the exterior atmosphere by means of at least one venting valve. When the external container is compressed (squeezed), the venting valve is tightly closed by the raised pressure in the air chamber so that no air can exit out of the air chamber. The pressure exerted on the external container is thus fully exerted on the filling material that exits in the above-described way out of the outlet opening of the valve. After termination of this process air enters due to the negative pressure, which is created in the intermediate chamber between the external container and the inner bag, through the venting valve into the air chamber and from there into the intermediate chamber between the external container and the inner bag because the venting valve opens due to the negative pressure until pressure compensation takes place.

The membrane which consists e.g. of TPE or LLDPE is firmly connected to the cap, which consists e.g. of PP, and is preferably injection-molded to the cap. Hence, the valve consists only of two components that can be mounted quickly and easily on the external container of the packaging.

The cap is here provided on its radially outer edge with a seal which engages into a surrounding groove in the shoulder of the external container. The seal may comprise two radially spaced-apart lips for each of which a surrounding groove is provided in the shoulder of the external container.

Preferably, two diametrically opposed venting valves are inserted into corresponding wall recesses of the annular air chamber of the cap, which may e.g. be glued in place.

In further details, it is suggested that the cap comprises a cylindrical inner wall which is spaced apart from the approximately bell-shaped outer wall and on the inside of which an also cylindrical inner wall of the membrane rests for laterally delimiting the receiving chamber for the filling material. The cylindrical inner wall of the membrane can here grip under the free end of the cylindrical inner wall of the cap and, together with the end section of the inner wall of the cap, may be tightly locked in place behind an annular projection of the base body.

In a preferred configuration of the invention the membrane is injection-molded together with its cylindrical inner wall on the cap which has the corresponding recesses for receiving the membrane.

The base body preferably rests on the edge of the container neck and is tightly pressed by a surrounding inner shoulder of the cap against the container edge. The base body, however, may also be inserted into the container neck.

The cap is preferably attached onto the container neck, the cap being locked in place with hook-like inner projections under an outer bead on the edge of the container neck.

When the valve is mounted, the base body is placed in the preferred embodiment on the edge of the container neck and is e.g. centered by an annular shoulder. Subsequently, the cap is mounted, whose cylindrical inner wall together with the abutting membrane wall locks in place in the base body, the cap further locking in place with its hook-like, radially and axially offset attachments under the outer bead of the container neck. In this process the at least one sealing lip (preferably two sealing lips) of the seal fastened to the edge can also enter into the associated groove of the external container, or it is pressed under preload against the shoulder. The sealing lip consists e.g. of TPE while the base body may e.g. consist of HDPE.

The pre-mounted system can also be snapped onto a filled bottle.

The venting valve has a cross-sectional shape which is convex with respect to the air chamber, and extends in the manner of a circular arc preferably on two diametrically opposed sides of the cap. A longitudinally oriented, preferably central cut which passes through the wall of the venting valve and is configured such that no material has been cut away extends through the wall of the venting valve. This venting valve opens in the case of a negative pressure in the air chamber of the cap in that the cut somewhat spreads apart, and is tightly closed in the case of an overpressure in the air chamber by the valve being compressed on the cut.

BRIEF DESCRIPTION OF THE DRAWINGS

Further details of the invention become apparent from the following description of a preferred embodiment of the packaging and from the drawings, in which.

DETAILED DESCRIPTION OF THE PREFERRED EMBODIMENT

Figure 1:
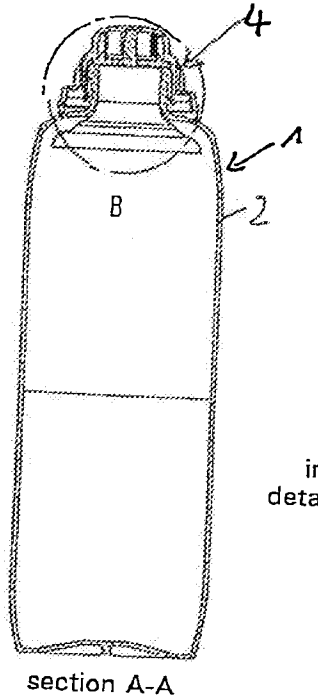
FIG. 1 is a longitudinal section through the whole packaging.

The whole packaging 1 is shown in FIG. 1 and contains a dimensionally stable, elastically deformable external container 2, an inner bag 3 which receives the filling material and which in the filled initial state rests on the inner wall of the external container 2 and is firmly connected in the neck portion thereof to the external container 2. The inner bag is also fixed to the bottom of the external container. The neck of the external container 2 has fastened thereto a valve 4 through the outlet opening 5 of which filling material is discharged when the external container 2 is compressed. In this process the inner bag 3 contracts accordingly without ambient air entering into the inner bag for pressure compensation, so that the packaging is a so-called airless system. The external container 2 is expediently compressed laterally by a user for discharging filling material; the external container may here also be designated as a squeeze container.

Figure 2:
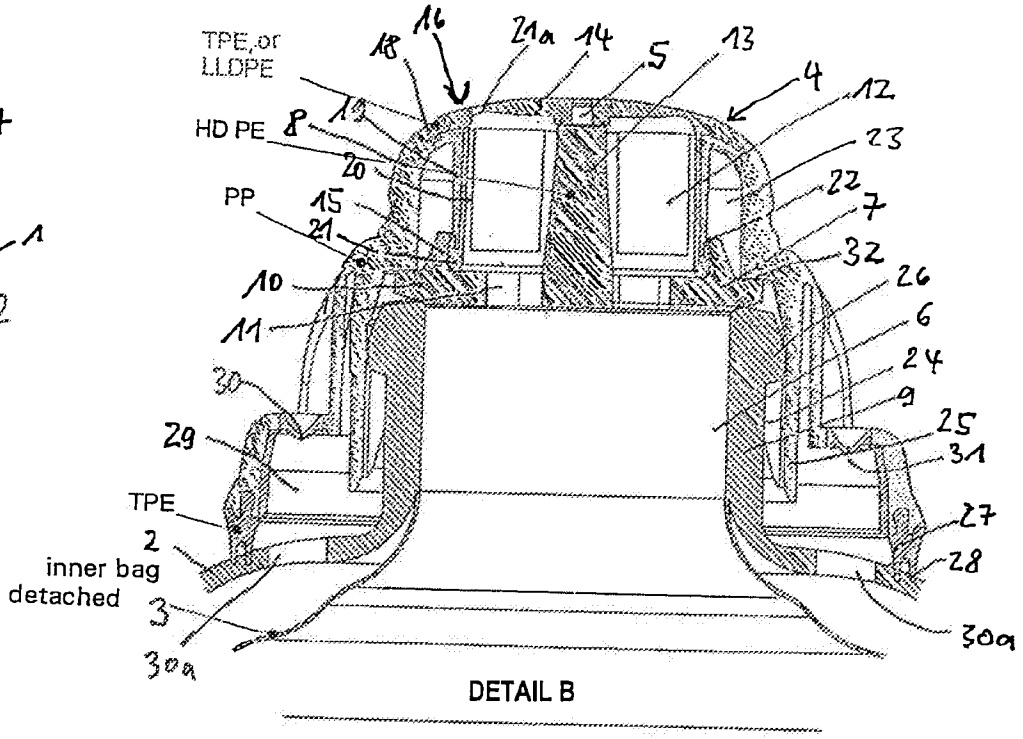
FIG. 2 is an enlarged view of area B in FIG. 1.
Figure 3:
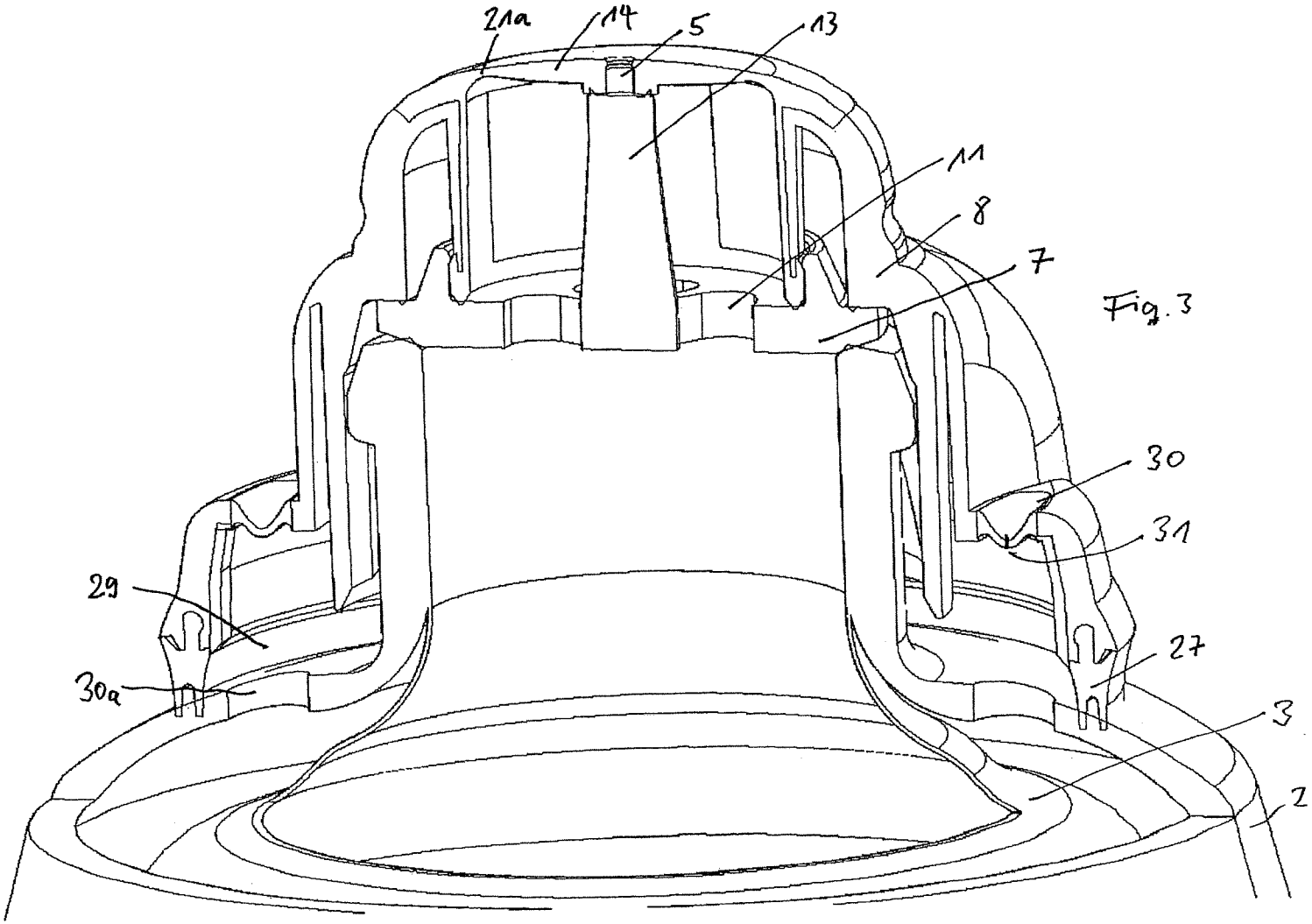
FIG. 3 is a partly cut-away perspective view of detail B in an even larger illustration.

FIGS. 2 and 3 show in more detail that the valve 4 consists essentially of a base body 7 extending transversely over the opening 6 of the external container 2 and of a cap 8 which is snapped on the outside onto the neck of the external container 2. The base body 7, which consists e.g. of HDPE, rests here with its circular edge portion on the upper edge of the container neck 9 and is firmly pressed by the cap 8 onto the container neck 9.

In the plate-shaped section 10 extending transversely over the opening 6 of the container neck 9, the base body 7 contains a plurality of circumferentially distributed through holes 11 which connect the inner chamber of the inner bag 3 to a receiving chamber 12 for filling material which is positioned above the plate-shaped section 10. Furthermore, the base body 7 contains a pin 13 which extends centrally in the longitudinal direction of the external container 2 and which in the center of the receiving chamber 13 for the filling material extends to the upper end wall 14 of the cap 8 and tightly closes the outlet opening 5 in the non-operated state of the packaging.

The base body 7 further contains an annular flange 15 which extends upwards, i.e. in the direction of the upper end wall 14 of the cap, and which comprises a radially inwardly oriented undercut on its free end.

The cap 8 which consists e.g. of PP grips over the base body 7 and the container neck 9 substantially in the form of a bell. The cap 8 which consists of rigid plastic is firmly connected to a membrane 16 which consists e.g. of TPE or LLDPE. With a slightly outwardly curved section the membrane 16 forms the upper end wall 14 of the cap 8 which centrally contains the outlet opening 5 for the filling material. On the inside around the outlet opening 6 the wall section 14 of the membrane 16 contains a thickened wall section 17 which in the released non-pressed state of the membrane 16 firmly lies on the flat upper side of the pin 13, namely due to the elastic restoring force of the membrane 16. The outlet opening 5 is thereby tightly closed.

The membrane 16 is fitted with the circumferential section 18 of the upper end wall 15 into an annular recess of the cap 8.

The cap 8 has an inwardly oriented cylindrical attachment 19 on the inside of which a corresponding cylindrical attachment 20 of the membrane 16 rests, which with a bead-like lower end section 21 grips tightly under or behind the lower end of the cylindrical section 19 of the cap 8.

In the preferred embodiment of the invention the membrane 16 is injection-molded onto the corresponding surfaces of the cap 8 and thereby integrally connected to the cap 8.

Together with the upper end wall 14, the cylindrical membrane wall 20 delimits the already mentioned receiving chamber 12 for the filling material. On the upper, radially outer edge of the receiving chamber 12, the cross section of the upper end wall 14 is weakened (reference numeral 21) so as to facilitate the elastic bulging of the upper end wall 14 by pressurized filling material in the receiving chamber 12. The filing material presses here over a large area against the membrane wall 14, so that an adequately large gap is directly created between the annular wall 17 and the upper side of the pin 13, through which the filling material can exit in unhindered fashion. When the filling material is a liquid, it exits out of the packaging in a jet extending in the axial direction of the hole 5. Thereafter the upper membrane wall will return into the initial state in which the pin 13 tightly closes the outlet opening 5. When mounted on the container neck 9, the cap will lock with the bead-like section 21 on the lower end of the cylindrical walls 19 and 20 behind, i.e. in the drawing under, the annular inner projection 22 of the annular flange 15, whereby a hermetic seal is created relative to a radially outer annular chamber 23. The cap 8 further locks in place with radially inner hook-like projections 24 on axial webs 25 under the outer bead 26 on the container neck.

A seal 27 which is preferably injection-molded into a surrounding groove in the wall of the cap 8 and contains two radially spaced-apart sealing lips 28 that engage into annular grooves in the wall of the external container 2 is positioned on the lower edge of the cap 8 which is on the whole stepped and bell-shaped. As a result, a lower air chamber 29 in the cap 8 is sealed relative to the external container 2, apart from the at least one hole 30*a* which passes through the wall of the external container and connects the intermediate chamber between the external container 2 and the inner bag 3 to the interior of the air chamber 29, and two diametrically opposed venting valves 30 through which in case of a negative pressure in the air chamber 29 ambient air can enter for pressure compensation into the air chamber 29, but through which in case of an overpressure in the air chamber 24, no air can escape to the exterior atmosphere.

To this end the two venting valves 30, each extending over a short circular arc, have a preferably round shape which is convex relative to the interior of the air chamber 29, i.e. forwardly bulged towards the air chamber 29, the wall of the venting valves containing a central cut 31 passing through the wall.

For discharging filling material the external container 2 is laterally compressed, whereby the inner bag is also compressed in the case of venting valves 30 that are firmly closed thereby, and filling material which passes through the holes 11 into the receiving chamber 12 and fills said chamber is pressed against the inner side of the upper end wall 14. The wall is thereby lifted from the upper side of the pin 13 with its wall portion 17 surrounding the outlet opening 5, so that filling material can exit in unhindered fashion. After release of the external container (i.e. after termination of the exertion of pressure) the upper end wall 14 of the membrane returns again into the sealing state. Due to the reduced volume of the inner bag, a negative pressure has been created in the intermediate chamber between the external container 2 and the inner bag 3, the negative pressure causing a negative pressure in the air chamber 29, with the consequence that ambient air enters for pressure compensation into the air chamber and through the hole 30*a* into the intermediate chamber between the external container 2 and the inner bag 3.

Figure 4:
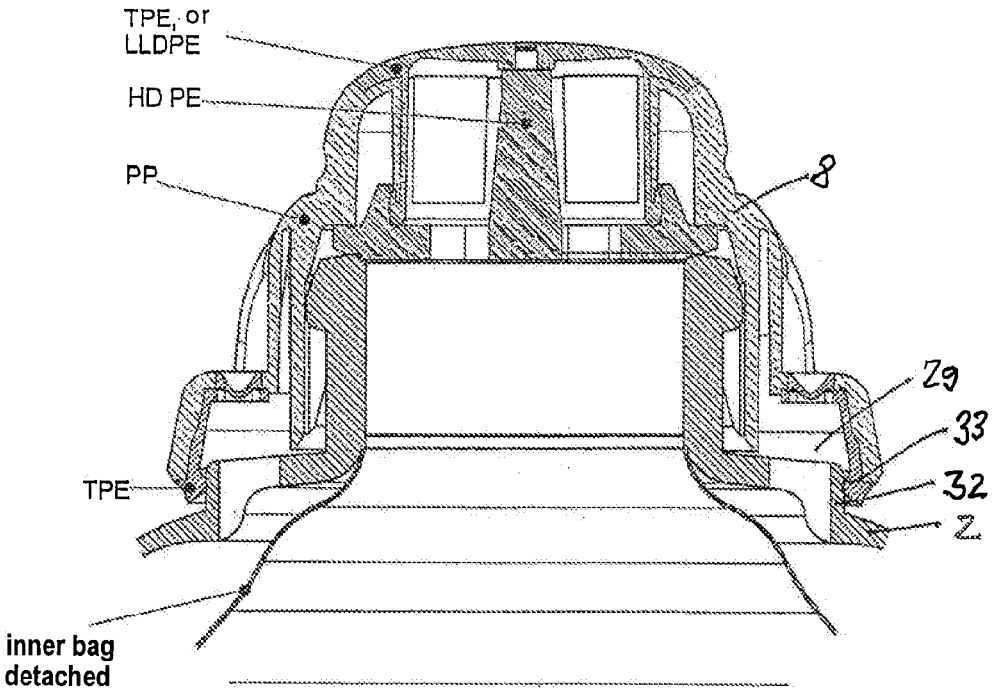
FIG. 4 shows an alternative embodiment of the packaging.

The embodiment shown in FIG. 4 differs from the first embodiment by a different sealing of the air chamber 29 relative to the external container 2. In the shoulder portion the external container 2 has a surrounding stepped shoulder 32 onto which a seal 33 provided on the lower edge of the cap 8 is firmly pressed in radial direction.

It is emphasized that the invention is not restricted to the described and illustrated embodiments. Rather, all of the disclosed features of the embodiments can be combined with one another in any useful way also individually.

The invention claimed is:

1. Packaging comprising an external container that is substantially dimensionally stable in an initial state and that is elastically deformable, an easily deformable inner bag arranged therein, which receives filling material, and a valve, wherein the valve comprises a base body which extends over the opening of the external container and comprises at least one through opening for the filling material and a pin oriented away from the external container, and a cap which is fastened to the neck of the external container and covers the base body and the upper end wall of which is formed by a membrane which delimits a receiving chamber for the filling material between the cap and the base body and comprises an outlet opening for the filling material which in the unpressurized state of the packaging is closed by the pin in that the membrane with the area containing the outlet opening rests under preload on the pin, the membrane being lifted from the pin upon exertion of pressure on the external container by the pressurized filling material contained in the receiving chamber, so that filling material can exit, and that the cap comprises an air chamber which is separated from the receiving chamber for the filling material and sealed relative to the receiving chamber and the external container and which is connected via at least one hole through the wall of the external container to the intermediate chamber between the external container and the inner bag and via at least one venting valve to the exterior atmosphere, wherein the cap comprises a cylindrical inner wall on the inside of which a cylindrical inner wall of the membrane rests, which laterally delimits the receiving chamber for the filling material, and wherein the cylindrical inner wall of the membrane grips under the free end of the cylindrical inner wall of the cap and is locked in place behind an annular projection of the base body.

2. The packaging according to claim 1, wherein the membrane is injection-molded on the cap.

3. The packaging according to claim 1, wherein the base body rests on the edge of the container neck and is pressed by a surrounding shoulder of the cap thereagainst.

4. The packaging according to claim 1, wherein the cap is locked in place with hook-like inner projections under an outer bead on the edge of the container neck.

5. The packaging according to claim 1, wherein the cap is provided on its outer edge with a seal which engages into a surrounding groove in a shoulder of the external container or rests with preload on the shoulder.

6. The packaging according to claim 1, wherein the at least one venting valve is closed in case of overpressure in the air chamber and is opened in case of a negative pressure in the air chamber.

7. The packaging according to claim 6, wherein two diametrically opposed venting valves are formed.

8. The packaging according to claim 6, wherein each venting valve has a convex cross-sectional shape with respect to the air chamber, with a central cut extending in longitudinal direction and through the wall of the venting valve.

9. The packaging according to claim 7, wherein each venting valve has a convex cross-sectional shape with respect to the air chamber, with a central cut extending in longitudinal direction and through the wall of the venting valve.

10. Packaging comprising an external container that is substantially dimensionally stable in an initial state and that is elastically deformable, an easily deformable inner bag arranged therein, which receives the filling material, and a valve, wherein the valve comprises a base body which extends over the opening of the external container and comprises at least one through opening for the filling material and a pin oriented away from the external container, and a cap which is fastened to the neck of the external container and covers the base body and the upper end wall of which is formed by a membrane which delimits a receiving chamber for the filling material between the cap and the base body and comprises an outlet opening for the filling material which in the unpressurized state of the packaging is closed by the pin in that the membrane with the area containing the outlet opening rests under preload on the pin, the membrane being lifted from the pin upon exertion of pressure on the external container by the pressurized filling material contained in the receiving chamber, so that filling material can exit, and that the cap comprises an air chamber which is separated from the receiving chamber for the filling material and sealed relative to the receiving chamber and the external container and which is connected via at least one hole through the wall of the external container to the intermediate chamber between the external container and the inner bag and via at least one venting valve to the exterior atmosphere, wherein the cap is provided on its outer edge with a seal which engages into a surrounding groove in a shoulder of the external container or rests with preload on the shoulder such that the air chamber is tightly sealed relative to the exterior atmosphere, wherein the cap comprises a cylindrical inner wall on the inside of which a cylindrical inner wall of the membrane rests, which laterally delimits the receiving chamber for the filling material, and wherein the cylindrical inner wall of the membrane grips under the free end of the cylindrical inner wall of the cap and is locked in place behind an annular projection of the base body.

* * * * *